US009242847B1

(12) United States Patent
Laible

(10) Patent No.: US 9,242,847 B1
(45) Date of Patent: Jan. 26, 2016

(54) CONTAINER INSERT FOR USE WITH A CLOSED LOOP DISPENSING SYSTEM

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

(21) Appl. No.: 14/585,377

(22) Filed: Dec. 30, 2014

(51) Int. Cl.
*B67D 3/00* (2006.01)
*B67D 7/02* (2010.01)

(52) U.S. Cl.
CPC ..... *B67D 7/0294* (2013.01); *B67D 7/0277* (2013.01)

(58) Field of Classification Search
CPC ..... B67D 7/0294; B67D 7/0277; B67D 7/36
USPC ..... 222/481.5, 188, 189.09, 189.1, 387, 222/478, 464.1, 464.2, 546, 547, 189.06; 251/149.4
See application file for complete search history.

(56) References Cited

U.S. PATENT DOCUMENTS 4,830,210 A * 5/1989 Mabille ..... B67D 7/0294 141/383
4,978,036 A * 12/1990 Burd ..... A47K 5/1208 222/181.2
5,238,153 A * 8/1993 Castillo ..... B05B 11/0021 222/189.09
5,927,559 A * 7/1999 Bommer ..... B05B 11/0016 222/189.09
5,971,221 A * 10/1999 Schwarz ..... B05B 7/2408 222/189.09
5,988,456 A * 11/1999 Laible ..... B67D 7/0294 222/464.1
6,142,345 A * 11/2000 Laible ..... B67D 7/0294 222/189.1
6,669,062 B1 * 12/2003 Laible ..... B67D 7/0294 141/244
6,840,410 B2 * 1/2005 Dark ..... B65D 47/2081 222/481.5
6,968,983 B2 11/2005 Laible
7,172,099 B2 * 2/2007 Hofte ..... A47L 13/22 222/481.5
8,083,107 B2 * 12/2011 Laible ..... B65D 47/283 222/189.09
2003/0150887 A1 * 8/2003 Laible ..... B67D 7/0294 222/529
2005/0006418 A1 * 1/2005 Rigel ..... B65D 47/061 222/481.5
2010/0213220 A1 * 8/2010 Laible ..... B67D 7/0294 222/481.5
2012/0104029 A1 * 5/2012 Haas ..... B67D 7/0294 222/1

* cited by examiner

*Primary Examiner* — J. Casimer Jacyna
*Assistant Examiner* — Benjamin R Shaw
(74) *Attorney, Agent, or Firm* — Dennis L. Thomte; Thomte Patent Law Office LLC

(57) ABSTRACT

An insert is disclosed for use with a closed loop dispensing system. The insert includes a flat, ring-shaped venting member which permits air to pass therethrough but prevents liquid from passing therethrough. A foam liner is positioned at the underside of the venting membrane to shield or protect the venting membrane when the retainer disc of the insert is secured to the lower end of the insert.

4 Claims, 4 Drawing Sheets

CONTAINER INSERT FOR USE WITH A CLOSED LOOP DISPENSING SYSTEM

BACKGROUND OF THE INVENTION

1. Field of the Invention

This invention relates to a closed loop dispensing system and more particularly to a dispensing system for dispensing corrosive liquid chemical or dangerous medical liquid products which are typically drawn from a container, such as a bottle or the like. Even more particularly, this invention relates to a container insert or throat plug which is press-fitted into the throat of the container with the container insert including a venting membrane for relieving vacuum pressure from within the bottle. Even more particularly, this invention relates to a means for preventing damage to the venting membrane when the retaining disc of the container insert is threadably secured to the lower end thereof 2. Description of the Related Art Many container inserts have been previously provided wherein a venting membrane is held in place in the container insert by a disc which is threadably secured to the lower end of the container insert. See for example, Applicant's U.S. Pat. Nos. 6,968,983; 6,669,062; 6,142,345 and 5,988,456. The venting membranes of the prior art are disc-shaped and are quite fragile. In some cases, when the retainer disc is threadably secured to the lower end of the container insert, the fragile venting membrane is torn or otherwise damaged due to the rotation of the retaining disc with respect to the venting membrane.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A container insert is disclosed for use with a closed loop dispensing system including a container having a throat with an inside surface. The insert includes a horizontally disposed ring-shaped lip having an upper side, a lower side, an outer side and an inner side. A generally cylindrical wall member, having an open upper end, an open lower end, an inner surface and an outer surface, extends downwardly from the inner end of the lip whereby the lip protrudes outwardly from the upper end of the wall member. The open lower end of the wall member has internal threads formed therein which have an upper end and a lower end. A generally horizontally disposed first annular shoulder extends inwardly from the inner surface of the wall member between the upper and lower ends thereof. The first annular shoulder has an upper end and a lower end. The first annular shoulder has a plurality of vertically disposed and spaced-apart vent openings, having upper and lower ends, which extend therethrough. The lower end of the first annular shoulder is positioned at the upper end of the internal threads in the lower end of the wall member.

The insert also includes an upstanding hollow valve body having an upper end, a lower end, an inside surface, and an outer surface which extends upwardly from the inner end of the first annular shoulder. A second annular shoulder, having an upper end and a lower end, extends inwardly from the inside surface of the valve body between the upper and lower ends thereof.

A flat, ring-shaped venting membrane, having an upper side and a lower side, is positioned at the lower end of the first annular shoulder so as to extend over the lower ends of the vent openings in the first annular shoulder. Preferably, the venting membrane is comprised of material such as GORE-TEX®. A flat, ring-shaped foam liner, having an upper side and a lower side, is positioned adjacent the lower side of the venting membrane. Preferably, the foam liner is comprised of a polyethylene foam material. The foam liner also has a plurality of spaced-apart openings extending therethrough. The foam liner also provides a resistance to crystallization of the membrane.

The insert includes an upstanding hollow valve stem having an upper end, a lower end, an outer surface and an inner surface is provided with the valve stem including an upper tubular member and a lower tubular member. The upper tubular member has a greater diameter than the lower tubular member. A third annular shoulder, having an upper end and a lower end, extends outwardly from the valve stem between the upper and lower ends thereof. The valve stem is vertically movably positioned in the valve body between upper and lower positions with respect thereto. The upper end of the third annular shoulder of the valve stem is in engagement with the lower end of the second annular shoulder when the valve stem is in its upper position.

The insert also includes a disc member or retainer which includes a body portion having an upper side and a lower side. The body portion of the disc member has external threads configured to be threadably connected to the interior threads of the open lower end of the wall member. The body portion of the disc member has a plurality of vent openings formed therein. The body portion of the disc member has a hollow dip tube support extending downwardly therefrom. The body portion of the disc member has a hollow tubular valve member extending upwardly therefrom. The valve member has a closed upper end which is received in the lower tubular portion of the valve stem. The valve member has at least one opening formed therein below the closed upper end thereof. A spring is positioned between the body portion of the disc member and the lower end of the third annular shoulder which yieldably urges the valve stem to its upper position.

As the disc member is screwed into the open lower end of the wall member, the upper surface of the disc member is in rotatable engagement with the foam liner to prevent contact between the upper end of the disc member and the venting membrane. The foam liner prevents any damage to the venting membrane during the attachment of the disc member to the lower end of the wall member.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 2:
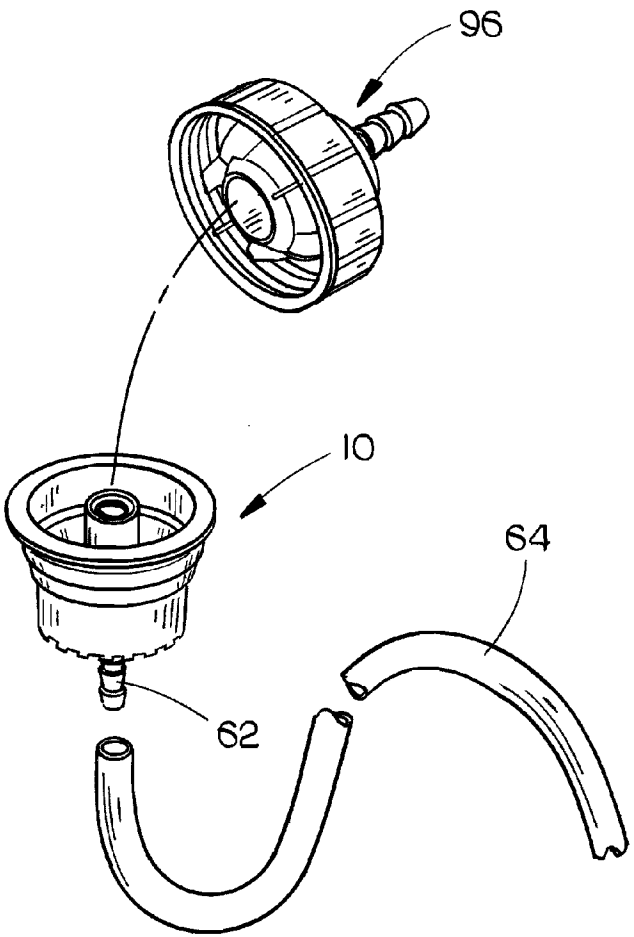
FIG. 2 is an exploded perspective view of the container insert of this invention and a cap which may be secured to the upper end of the container.
Figure 1:
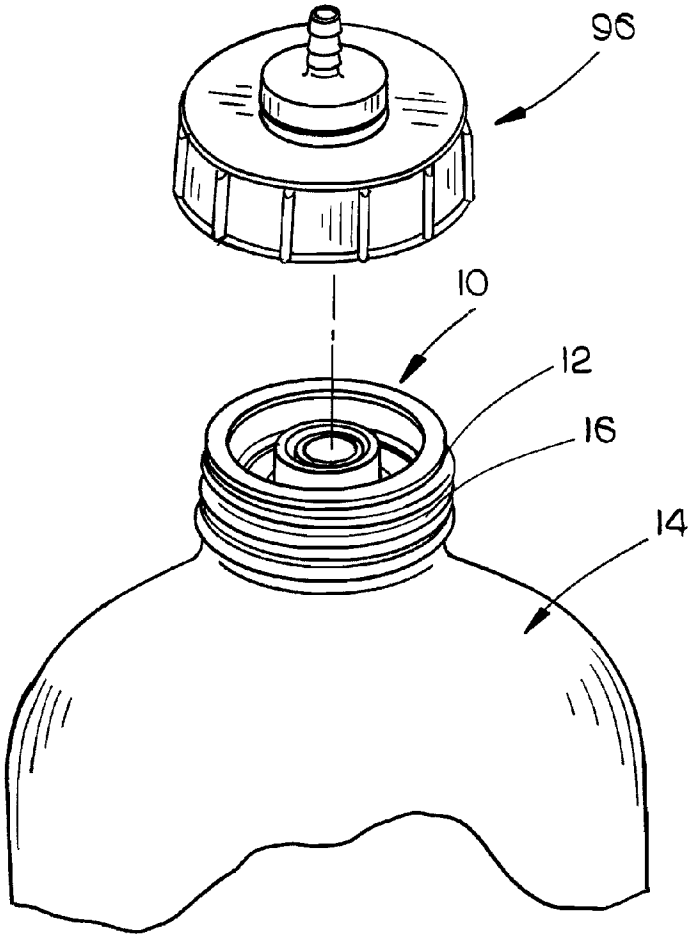
FIG. 1 is a perspective view of a container having the container insert of this invention inserted into the throat of the container.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to a container insert or throat plug assembly (hereinafter "insert") which is press-fitted into the throat or outlet opening 12 of a container 14 such as a bottle or the like. Preferably, throat 12 includes external threads 16. Insert 10 includes an open upper end 18 and an open lower end 20. Insert 10 includes a ring-shaped upper flange, a lip 22 and a first cylindrical wall member 24 which extends downwardly from the inner end of lip 22 and a first cylindrical wall member 24 which extends downwardly from the inner end of lip 22. The outer surface of wall member 24 has a cylindrical recess 26 formed therein. A seal 28 is positioned in recess 26 as shown and described in the pending patent application Ser. No. 14/288,446 filed May 28, 2014, the disclosure of which is incorporated herein by reference thereto to complete this disclosure if necessary. The disclosure of U.S. Pat. No. 5,988,456 is also incorporated by reference thereto to complete this disclosure if necessary.

The lower end of wall member 24 has an inwardly and downwardly tapered lower end or shoulder 30. Wall member 32 extends downwardly from the inner end of shoulder 30 and has a lower end 34. The insert 10 has internal threads 36 formed in the lower end thereof. Insert 10 includes a horizontally disposed ring-shaped wall portion 38 having a plurality of radially spaced-apart vent openings 40 extending downwardly therethrough. The numeral 41 refers to a shoulder at the lower side of wall portion 38 which is at the upper end of threads 36.

The numeral 42 refers to an upstanding hollow receiver having an inwardly extending shoulder 44 below the upper end thereof. Receiver 42 includes a cylindrical wall portion 46 which extends upwardly from shoulder 44 and which has an upper end 48. Receiver 42 defines a lower fluid passageway 50 and an upper fluid passageway 52.

The numeral 54 refers to a disc member or retainer having external threads 56 which are complimentary to the internal threads 36 in insert 10 so that disc member 54 may be threadably secured to the lower end of insert 10. The upper surface of disc member 54 has an annular groove or recess 58 formed therein. A plurality of vent openings 60 extend downwardly through disc member 54. Disc member 54 includes a hollow barbed dip tube support 62 which extends downwardly therefrom for connection to a dip tube 64. The numeral 66 refers to a hollow valve body which is integrally formed with disc member 54 and which is in communication with the interior of dip tube support 62. The upper end 68 of valve body 66 is closed, as seen in the drawings. The side wall of valve body 66, below the upper end 68 is provided with a pair of openings 70 formed therein to permit the liquid being drawn from the bottle or container 14, through dip tube 64, to pass through valve body 66, as will be described in detail hereinafter.

The numeral 72 refers to a valve stem which is generally cylindrical and includes a lower, cylindrical body portion 74 having bore 76 formed therein which slidably receives valve body 66 therein. Valve stem 72 also includes an upper tapered, generally cylindrical body portion 78 having a bore 80 formed therein. Bore 80 has a greater diameter than bore 76. Annular shoulder 82 extends outwardly from valve stem 72 between body portions 68 and 74. The numeral 84 refers to a spring having a lower end 86 and an upper end 88, as will be discussed in more detail hereinafter.

Figure 3:
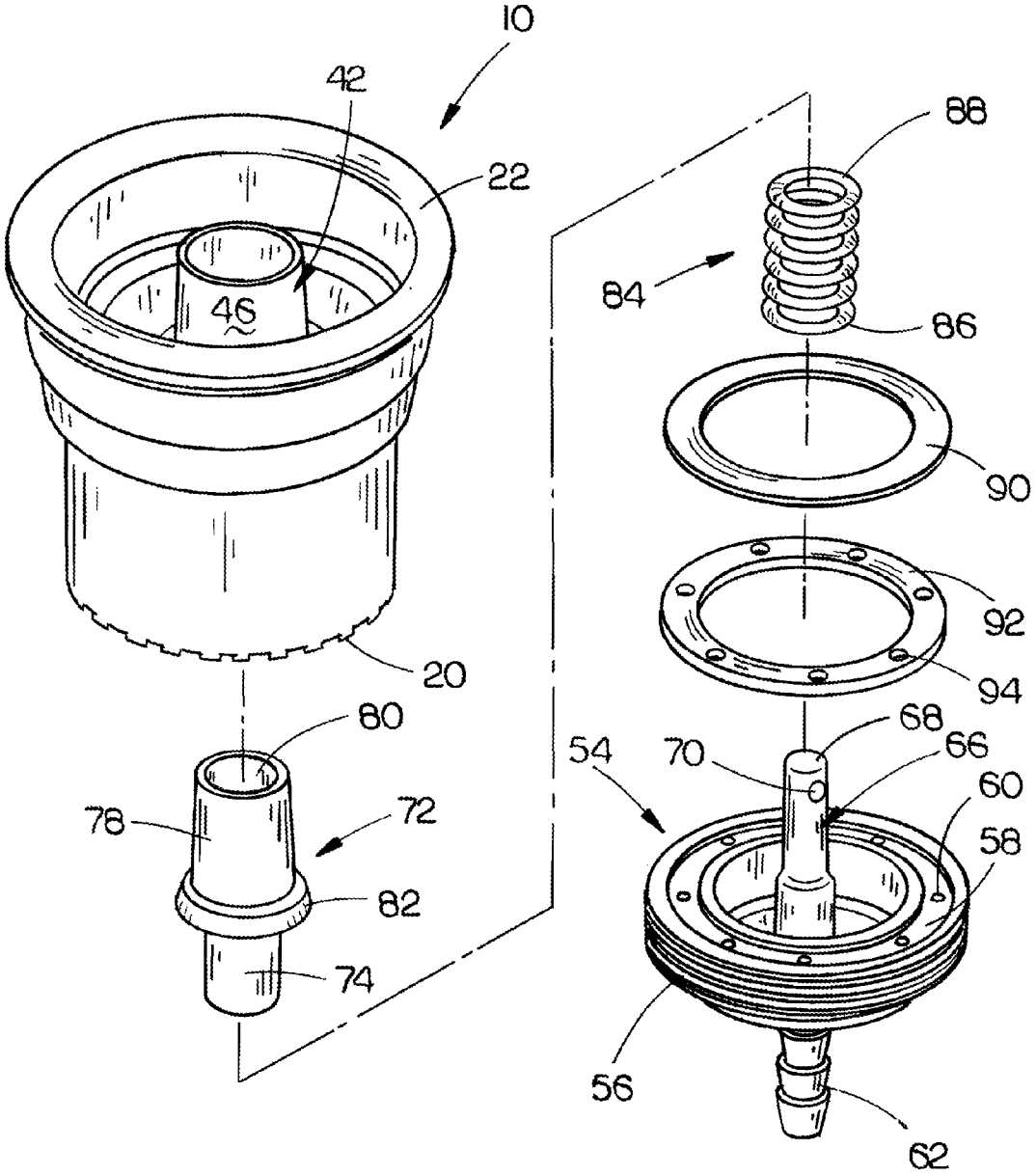
FIG. 3 is an exploded perspective view of the container insert of this invention.

The numeral 90 refers to a flat, ring-shaped venting membrane which is preferably comprised of a material such as GORE-TEX® so that air may pass therethrough but which prevents liquid from passing therethrough. Membrane 90 is positioned at the underside of shoulder 41 at the lower side of wall portion 32 so as to extend beneath the lower ends of the vent openings 40. The numeral 92 refers to a flat, ring-shaped foam liner which is preferably comprised of a polyethylene material. Liner 92 has a plurality of vent openings 94 formed therein, as seen in FIG. 3. Liner 92 is positioned at the underside of membrane 90, as seen in FIG. 3.

Figure 4:
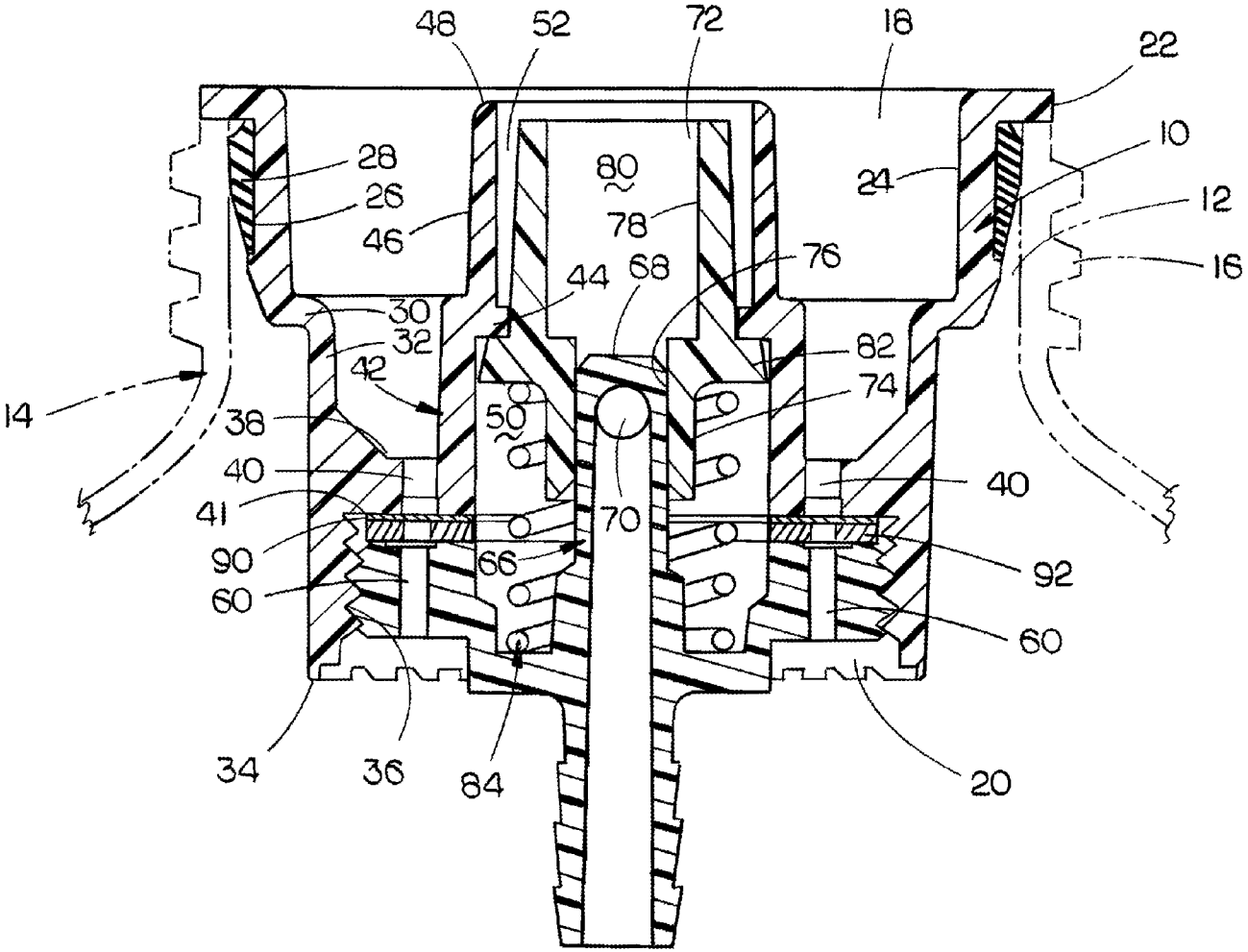
FIG. 4 is a sectional view illustrating the container insert of this invention mounted in the throat of a container.
Figure 5:
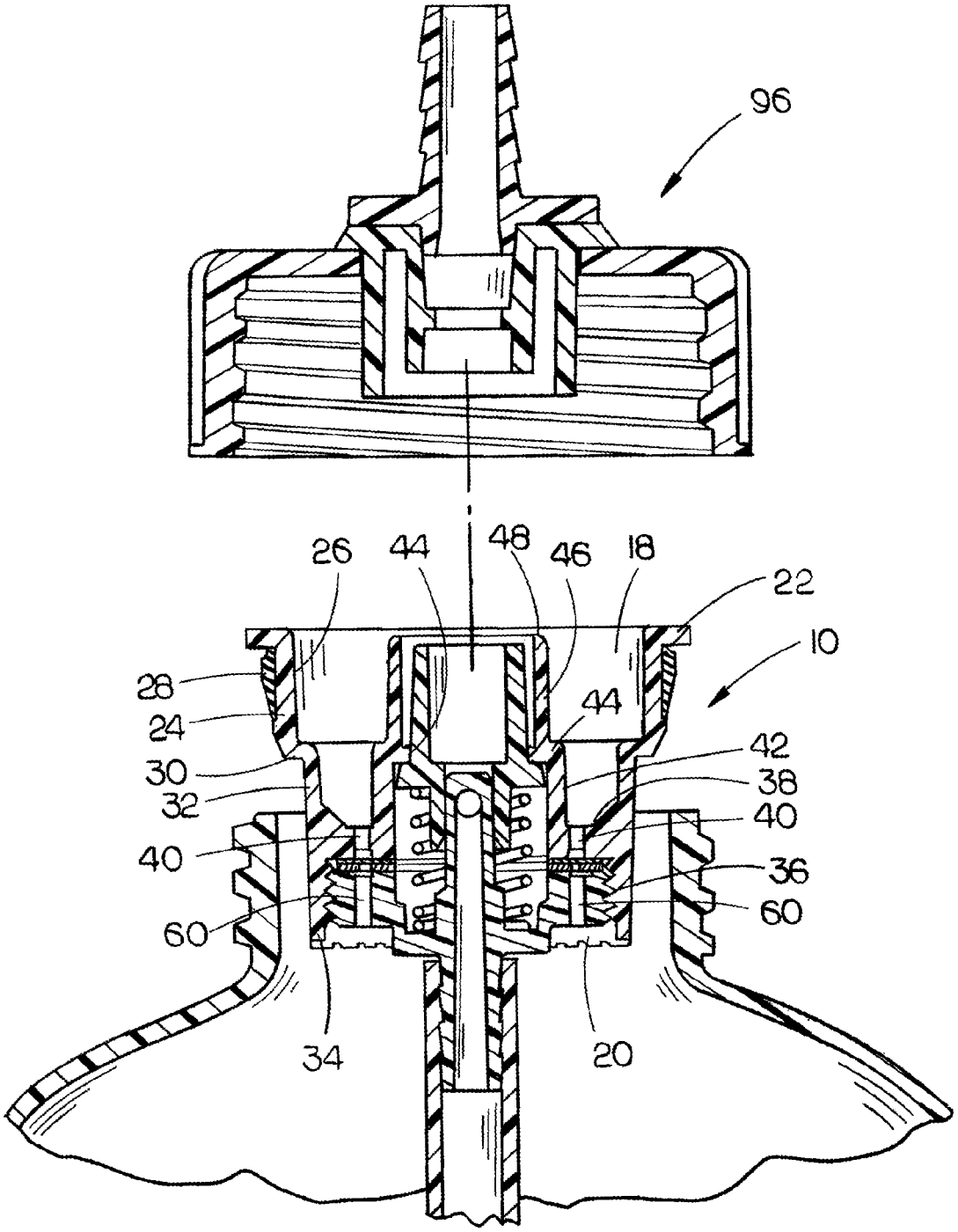
FIG. 5 is a sectional view similar to FIG. 4 but which also illustrates a cap which may be secured to the container.

The lower end 86 of spring 84 embraces the valve body 66 and engages the upper side of disc member 54. The upper end 88 of spring 84 engages the lower end of annular shoulder 82 of valve stem 72 to yieldably urge valve stem 72 to its upper position, as seen in FIG. 4, wherein the upper end of shoulder 82 sealably engages the lower end of shoulder 44. In the upper position of valve stem 72 (FIG. 4), the openings 70 in valve body 66 are closed by the cylindrical body portion 66 thereby preventing liquid from the container 14 from passing upwardly through insert 10.

As disc member 54 is rotatably threadably screwed onto the lower end of wall member 30, the upper end of disc member 54 only engages the foam liner 92 thereby preventing any tearing, crimping, or otherwise damaging the membrane 90.

When the insert 10 is positioned in the throat 12 of the container 14, the cap 96 is threadably secured onto the threads 16 of container 14. The cap 96 has structure therein such as disclosed in the above identified patents which engages and moves the valve stem 72 downwardly so that openings 70 communicate with the bore 80 so that suction applied to the system causes liquid from the container 14 to be drawn upwardly through the insert 10. As liquid is drawn from the container 14, venting air passes downwardly through the vent openings 40, through membrane 90, through the openings 94 in liner 92, through vent openings 60 into the interior of the container 14. Air is able to pass through membrane 90 as disclosed in the above-identified patents but liquid cannot pass through the membrane 90.

Thus it can be seen that a unique foam liner 92 has been provided which shields or protects the membrane 90 from damage. The liner 92 also prevents liquids from crystallizing on the membrane 90. It can therefore be seen that the invention accomplishes all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. An insert for use with a closed loop dispensing system including a container having a throat with an inside surface, comprising:

a horizontally disposed ring-shaped lip having an upper side, a lower side, an outer end, and an inner end;

a generally cylindrical wall member having an open upper end, an open lower end, an inner surface and an outer surface;

said wall member extending downwardly from said inner end of said lip whereby said lip protrudes outwardly from said upper end of said wall member;

said open lower end of said wall member having internal threads formed therein which have an upper end and a lower end;

a generally horizontally disposed first annular shoulder extending inwardly from said inner surface of said wall member;

said first annular shoulder having an upper end and a lower end;

said first annular shoulder having a plurality of vertically disposed and spaced-apart vent openings, having upper and lower ends, extending therethrough which are spaced inwardly of said internal threads in said lower end of said wall member;

said lower end of said first annular shoulder being positioned at said upper end of said internal threads in said lower end of said wall member;

an upstanding hollow valve body having an upper end, a lower end, an inside surface, and an outer surface, extending upwardly from said inner end of said first annular shoulder;

a second annular shoulder, having an upper end and a lower end, extending inwardly from said inside surface of said valve body between said upper and lower ends of said valve body;

a flat, ring-shaped venting membrane, having an upper side and a lower side, positioned at said lower end of said first annular shoulder so as to extend over said lower ends of said vent openings in said first annular shoulder;

a flat, ring-shaped foam liner, having an upper side and a lower side, positioned adjacent said lower side of said venting membrane;

said foam liner having a plurality of vent openings formed therein;

an upstanding hollow valve stem having an upper end, a lower end, an outer surface and an inner surface;

said valve stem including an upper tubular member and a lower tubular member;

said upper tubular member having a greater diameter than said lower tubular member;

a third annular shoulder, having an upper end and a lower end, extending outwardly from said valve stem between said upper and lower ends thereof;

said valve stem being vertically movably positioned in said valve body between upper and lower positions with respect thereto;

said upper end of said third annular shoulder of said valve stem being in engagement with said lower end of said second annular shoulder when said valve stem is in said upper position;

a disc member including a body portion having an upper side and a lower side;

said body portion of said disc member having external threads configured to be threadably connect to said interior threads of said open lower end of said wall member;

said body portion of said disc member having a plurality of vent openings formed therein;

said body portion of said disc member having a hollow dip tube support extending downwardly therefrom;

said body portion of said disc member having a hollow tubular valve member extending upwardly therefrom;

said valve member having a closed upper end which is received in said lower tubular portion of said valve stem;

said valve member having at least one opening formed therein below said closed upper end thereof;

a spring positioned between said body portion of said disc member and said lower end of said third annular shoulder which yieldably urges said valve stem to its said upper position.

2. The insert of claim 1 wherein said foam liner is comprised of a polyethylene material.

3. A container insert, comprising:

a generally cylindrical wall member having an open upper end, an open lower end, and a fluid passageway extending between said upper and lower ends thereof;

a valve means in said fluid passageway which is movable between open and closed positions;

a horizontally disposed, flat ring-shaped venting membrane within said wall member;

said venting membrane having an upper side and a lower side;

a horizontally disposed, flat ring-shaped foam liner having an upper side and a lower side;

said foam liner having a plurality of vent openings extending therethrough;

said foam liner being positioned at said lower side of said venting membrane to shield said venting membrane;

and a disc member, having upper and lower side, threadably secured to said lower end of said wall member;

said upper side of said disc member being in engagement with said lower side of said foam liner.

4. The container of claim 3 wherein said foam liner is comprised of a polyethylene material.

* * * * *